US007520151B1

(12) United States Patent
Harmon

(10) Patent No.: US 7,520,151 B1
(45) Date of Patent: Apr. 21, 2009

(54) QUICK ACTION PADLOCK PROTECTOR POUCH AND CHAIN LOCKING SYSTEMS

(76) Inventor: David Harmon, 106 Heritage Creek Dr., Rhome, TX (US) 76078-2112

( * ) Notice: Subject to any disclaimer, the term of this patent is extended or adjusted under 35 U.S.C. 154(b) by 0 days.

(21) Appl. No.: 12/009,192

(22) Filed: Jan. 17, 2008

(51) Int. Cl.
*E05B 67/38* (2006.01)

(52) U.S. Cl. ..... 70/56; 70/DIG. 43; 70/DIG. 56; 383/41; 383/66; 383/86

(58) Field of Classification Search ..... 70/54–56, 70/417, 423, 424, 455, DIG. 43, DIG. 56; 383/41, 66, 86
See application file for complete search history.

(56) References Cited

U.S. PATENT DOCUMENTS

| | | | | | |
|---|---|---|---|---|---|
| 696,620 | A | * | 4/1902 | Young | 70/56 |
| 733,765 | A | * | 7/1903 | Stroh | 224/245 |
| 858,264 | A | | 6/1907 | Daugherty | |
| 1,171,896 | A | * | 2/1916 | Simpson | 206/373 |
| 1,244,404 | A | * | 10/1917 | Ankovitz | 70/56 |
| 1,560,442 | A | * | 11/1925 | Trowbridge | 150/112 |
| 1,581,953 | A | | 4/1926 | Jackson | |
| 1,688,699 | A | * | 10/1928 | Gardner, Jr. | 206/256 |
| 1,978,257 | A | * | 10/1934 | Gardiner | 206/260 |
| 2,114,913 | A | * | 4/1938 | Crossman | 70/56 |
| 2,455,527 | A | * | 12/1948 | Seamon | 150/136 |
| 4,033,156 | A | * | 7/1977 | Cottingham | 70/56 |
| 4,651,543 | A | | 3/1987 | Heald et al. | |
| 5,003,795 | A | | 4/1991 | Hoke | |
| 5,168,258 | A | * | 12/1992 | Radke | 340/542 |
| 5,275,028 | A | * | 1/1994 | Giarrante | 70/56 |
| 5,590,760 | A | * | 1/1997 | Astarb | 206/6 |
| 5,595,073 | A | * | 1/1997 | Sullivan | 70/18 |
| 5,657,862 | A | * | 8/1997 | Burke | 206/38 |
| 6,192,721 | B1 | | 2/2001 | Monteleone | |
| 6,526,786 | B1 | * | 3/2003 | Kayoda | 70/56 |
| 6,578,393 | B2 | * | 6/2003 | Yarborought | 70/56 |
| 6,612,432 | B2 | * | 9/2003 | Motson | 206/305 |
| 2003/0152294 | A1 | * | 8/2003 | Diep | 383/8 |

* cited by examiner

*Primary Examiner*—Lloyd A Gall
(74) *Attorney, Agent, or Firm*—McAfee & Taft

(57) ABSTRACT

A padlock protector pouch that can be used to cover and protect a padlock, including a padlock body and a padlock shackle, and associated chain links of a chain that are locked together by the padlock without unlocking the padlock and removing the chain links therefrom. A locking system is also provided.

3 Claims, 5 Drawing Sheets

QUICK ACTION PADLOCK PROTECTOR POUCH AND CHAIN LOCKING SYSTEMS

BACKGROUND OF THE INVENTION

Padlocks are commonly used in connection with chains to lock gates and other structures on farms, around oil fields and the like. Unfortunately, in most situations, the padlocks as well as the chain(s) attached thereto are exposed to environmental elements such as heat, cold, moisture, salt and debris such as dust and dirt.

Moisture and debris can enter the body of the padlock through the shackle openings and the key entry. Once moisture and debris are inside the padlock body, they can begin to cause rust and wear. In the winter, moisture freezes and exerts pressure on the internal lock mechanism. When debris mixes with the moisture, the problem inside the padlock is exacerbated. As a result, the padlocks can be frozen shut and otherwise fail.

In many environments, including oil field sites and sites on or near an ocean, salt is also an issue. Salt can also enter the padlock body and corrode the internal lock mechanism.

In order to address the problem, certain types of padlock covers have been developed. One type of padlock cover covers the body of the padlock but not the shackle. The shackle extends through openings in the padlock cover. This may still allow moisture, salt and/or debris to travel along the shackle through the shackle openings into the padlock body. Also, in order to install or remove this type of cover, the lock must be unlocked so that the shackles can be inserted through or removed from the openings in the cover. During extreme weather conditions, this can be a difficult process. Furthermore, such covers do not protect the chain links attached to the shackle.

SUMMARY OF THE INVENTION

In one aspect, the invention provides a padlock protector pouch that can be used to cover and protect a padlock, including a padlock body and a padlock shackle, and associated chain links of a chain that are locked together by the padlock without unlocking the padlock and removing the chain links therefrom. The padlock protector pouch comprises a back panel, an inner panel, a flap, and a fastening system.

The back panel has a front, a back, a top edge and a bottom edge. Opposing side edges are disposed between the top edge of the back panel and the bottom edge of the back panel.

The inner panel has a front, a back, a top edge and a bottom edge. Opposing side edges are disposed between the top edge of the inner panel and the bottom edge of the inner panel. The bottom edge and opposing side edges of the inner panel are attached to the bottom edge and opposing side edges of the back panel to form a pocket having an opening for receiving the padlock. The top edge of the inner panel is spaced below the top edge of the back panel.

The flap has a front, a back, a top edge and a bottom edge. Opposing side edges are disposed between the top edge of the flap and the bottom edge of the flap. The flap is attached to the top edge of the back panel and attachable to the front of the inner panel over the opening in the pocket. The pouch includes an opening in each side of the pouch between the top edge of the inner panel and the top edge of the back panel for receiving the chain links when the flap is attached to the front of the inner panel over the opening in the pocket.

The fastening system is attached to one or both of the front of the inner panel and the front of the flap for attaching the flap to the front of the inner panel over the opening in the pocket.

The padlock protector pouch is of a size sufficient for the flap to extend over and cover all of the padlock, including the padlock body and the padlock shackle, and the chain links extending through the openings in the sides of the pouch and attached to the padlock shackle when the padlock is positioned in the pocket with the chain links attached thereto and the flap is attached to the front of the inner panel and over the opening in the pocket.

In another aspect, the invention comprises a locking system. In one embodiment, the locking system comprises a padlock and the inventive padlock protector pouch. The padlock includes a padlock body and a padlock shackle and is capable of receiving chain links of a chain to lock the links together. The padlock protector pouch can be used to cover and protect the padlock, including the padlock body and the padlock shackle, and the chain links received by the padlock when the chain links are locked together by the padlock. The padlock protector pouch is capable of covering and protecting the padlock and chain links without unlocking the padlock and removing the chain links therefrom.

In another embodiment, the inventive locking system comprises a chain including a plurality of chain links attached to one another, a padlock and the inventive padlock protector pouch. The padlock includes a padlock body and a padlock shackle and is capable of receiving one or more of the chain links of the chain to lock the links together. The padlock protector pouch can be used to cover and protect the padlock, including the padlock body and the padlock shackle, and the chain links received by the padlock when the chain links are locked together by the padlock. The padlock protector pouch is capable of covering and protecting the padlock and chain links without unlocking the padlock and removing the chain links therefrom.

DETAILED DESCRIPTION

The invention includes a padlock protector pouch and a locking system. The locking system includes the inventive padlock protector pouch.

Figure 1:
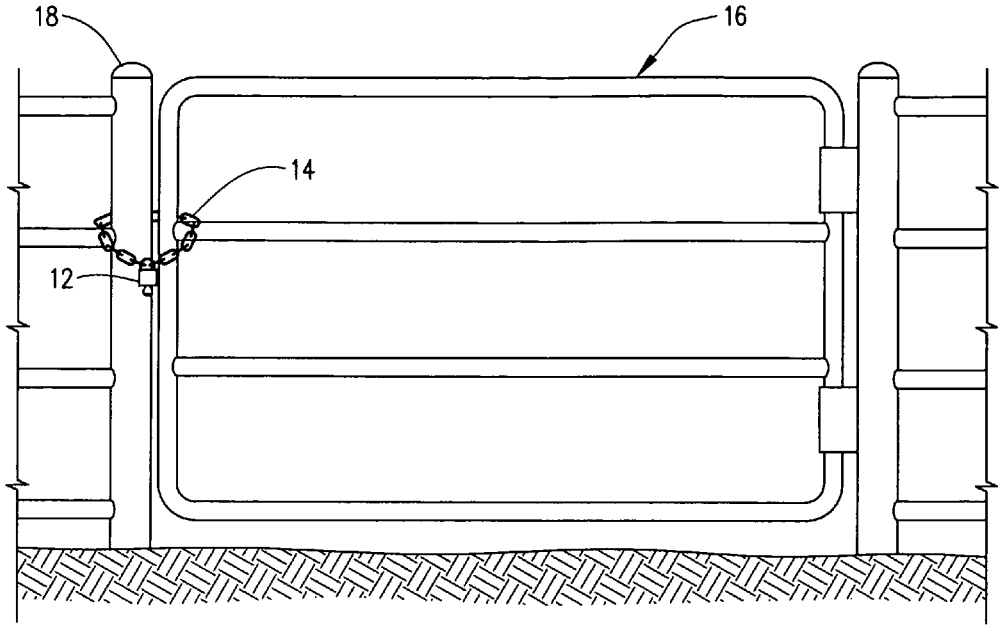
FIG. 1 PRIOR ART
FIG. 1 is a front view of a typical gate locked in a closed position using a padlock and chain.
Figure 1A:
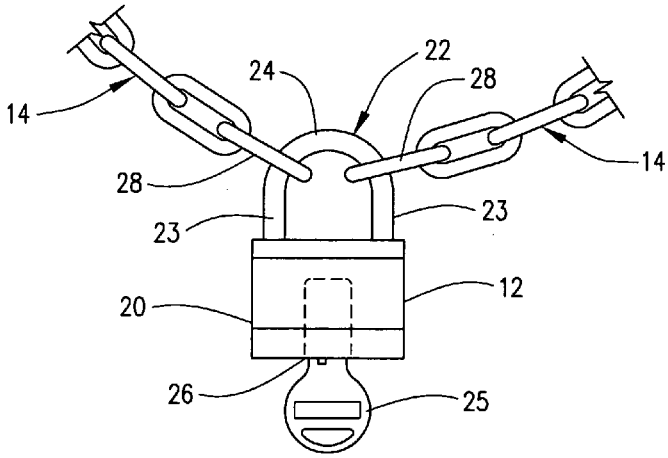
FIG. 1A is an exploded view of the padlock and a portion of the chain shown by FIG. 1
Figure 2:
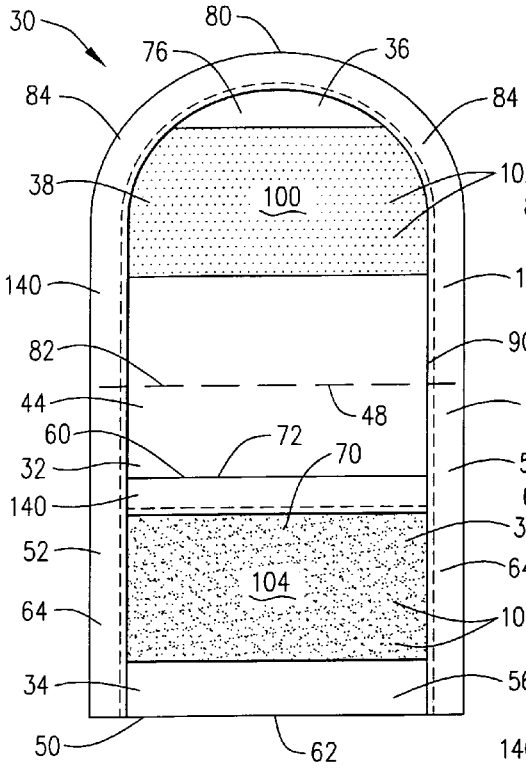
FIG. 2 is a front elevation view of the inventive padlock protector pouch.
Figure 2A:
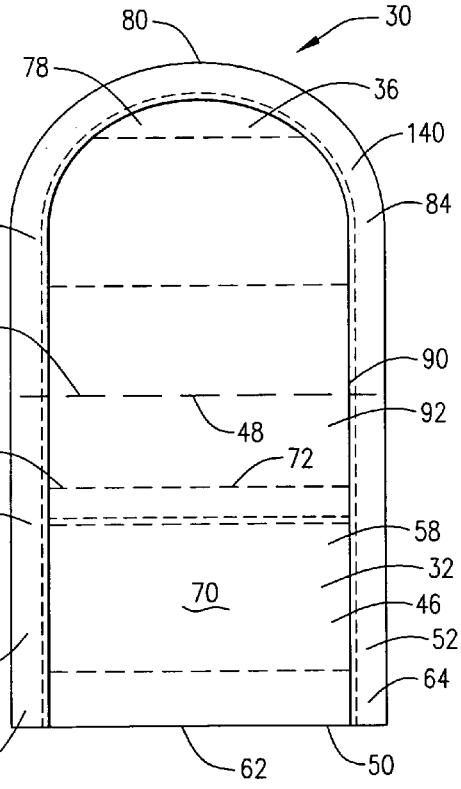
FIG. 2A is a rear elevation view of the inventive padlock protector pouch.
Figure 2B:
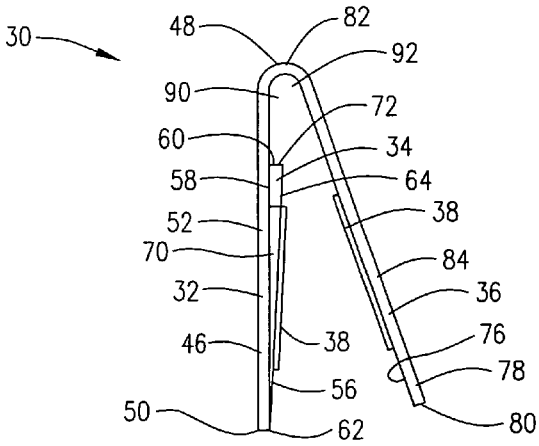
FIG. 2B is a side elevation view of the inventive padlock protector pouch.

FIG. 1 illustrates a padlock 12 and chain 14 as used to lock a gate 16 in a closed position. The gate 16 is locked by the padlock 12 and chain 14 to a corresponding side post 18. As best shown by FIG. 1A, the padlock 12 includes a padlock body 20 and a padlock shackle 22. The padlock shackle 22 includes two arms 23 that extend into the padlock body 20 and an upper base 24 connecting the arms 23 together. A key 25 is removably inserted into an opening 26 in the bottom of the padlock 12. The padlock shackle 22 is inserted through associated chain links 28 of the chain 14 to lock the links together. As used herein and in the appended claims, a "padlock shackle" means a padlock shackle having two arms (such as the arms 23) that extend into the padlock body and an upper base (such as the upper base 24) that connects the arms 23 together. For example, the upper base can be curved causing the padlock shackle have a "U-shape" as shown in the drawings or can be straight causing the shackle to have a "half-rectangle" or similar shape.

Referring now to FIGS. 2-7, the inventive padlock protector pouch is illustrated and generally designated by the reference numeral 30. The padlock protector pouch 30 can be used to cover and protect a padlock (such as the padlock 12), and associated chain links of a chain (such as the chain links 28 of the chain 14) that are locked together by the padlock without unlocking the padlock and removing the chain links therefrom.

The padlock protector pouch 30 comprises a back panel 32, an inner panel 34, a flap 36, and a fastening system 38. As described further below, the back panel 32, inner panel 34 and flap 36 can be integrally formed together. The back panel 32 has a front 44, a back 46, a top edge 48, a bottom edge 50 and opposing side edges 52 disposed between the top edge 48 of the back panel 32 and the bottom edge 50 of the back panel 32.

The inner panel 34 has a front 56, a back 58, a top edge 60, a bottom edge 62 and opposing side edges 64 disposed between the top edge 60 of the inner panel 34 and the bottom edge 62 of the inner panel 34. The bottom edge 62 and opposing side edges 64 of the inner panel 34 are attached to the bottom edge 50 and opposing side edges 52 of the back panel 32 to form a pocket 70 having an opening 72 for receiving the padlock. The top edge 60 of the inner panel 34 is spaced below the top edge 48 of the back panel 32.

The flap 36 includes a front 76, a back 78, a top edge 80, a bottom edge 82 and opposing side edges 84 disposed between the top edge 80 of the flap and the bottom edge 82 of the flap. The flap 36 is attached to the top edge 48 of the back panel 32 and attachable to the front 56 of the inner panel 34 over the opening 72 in the pocket 70.

Figure 4:
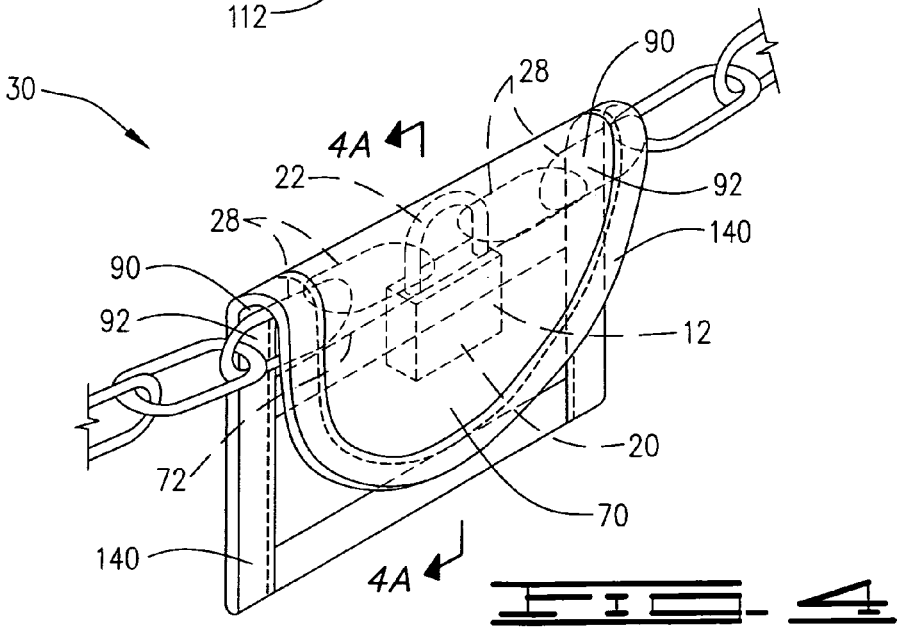
FIG. 4 is a perspective view showing the inventive padlock protector pouch in a closed position with a padlock and chains therein.

The padlock protector pouch 30 includes an opening 90 in each side 92 of the pouch between the top edge 60 of the inner panel 34 and the top edge 48 of the back panel 32. The openings 90 receive the chain links when the flap 36 is attached to the front 56 of the inner panel 34 over the opening 72 of the pocket 70. The openings 90 in the sides 92 of the padlock protector pouch 30 are each preferably at least three-fourths (¾) of an inch in length, that is, at least three fourths (¾) of an inch in length from the top of the opening to the bottom of the opening as the opening is shown by FIG. 4, for example.

The fastening system 38 is attached to one or both of the front 56 of the inner panel 34 and the front 76 of the flap 36 for attaching the flap to the front 56 of the inner panel over the opening 72 in the pocket 70. As illustrated by FIG. 4, the padlock protector pouch 30 is of a size sufficient for the flap 36 to extend over and cover all the padlock 12, including the padlock body 20 and padlock shackle 22, and the chain links 28 extending through the openings 90 in the sides 92 of the pouch and attached to the padlock shackle when the padlock is positioned in the pocket 70 with the chain links attached thereto and the flap is attached to the front 56 of the inner panel 34 and over the opening 72 in the pocket 70.

In the embodiment shown by the drawings, the fastening system 38 is a hook and loop-type fastening system including a first fastening panel 100 having a plurality of small hooks 102 extending therefrom and a second fastening panel 104 having a plurality of corresponding loops 106 extending therefrom. One of the first and second fastening panels 100 and 104 are attached to the front 76 of the flap 36, and the other of the first and second fastening panels is attached to the front 56 of the inner panel 34. As understood by those skilled in the art, due to the hooks 102 and corresponding loops 106, the first fastening panel 100 detachably interlocks with the second fastening panel 104 to fasten the flap 36 to the inner panel 34.

Figure 3:
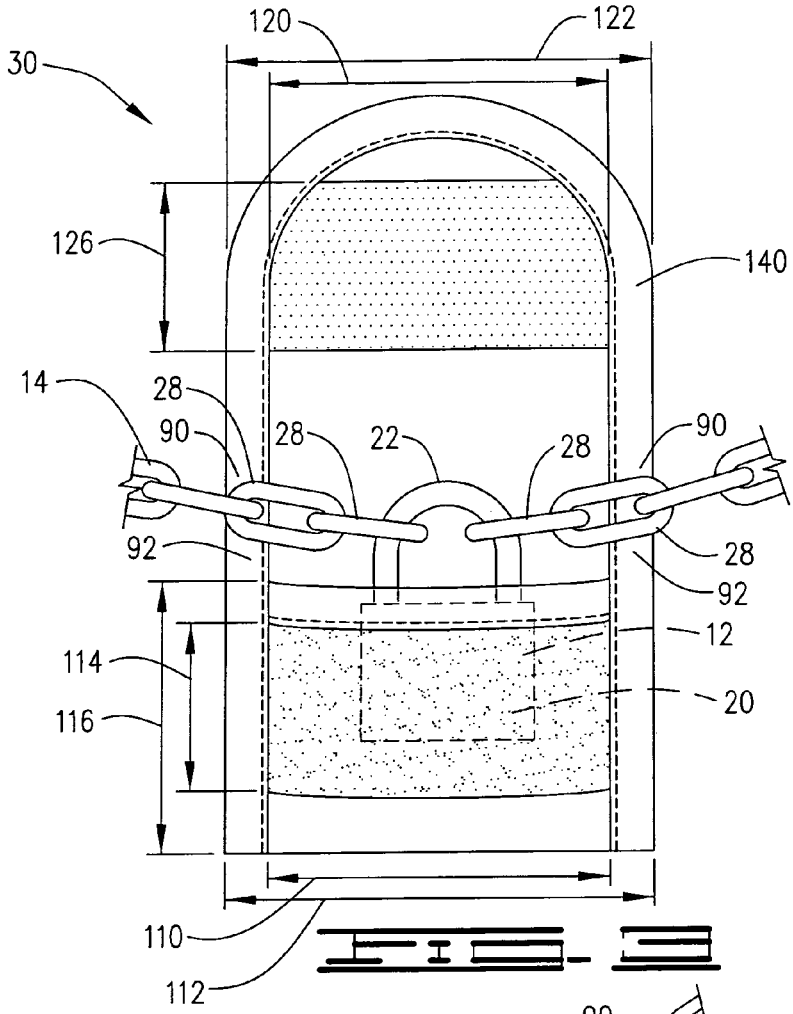
FIG. 3 is a front elevation view of the inventive padlock protector pouch in an open position with a padlock and chains therein.

As illustrated by FIG. 3, the first or second fastening panel 100 or 104 attached to the front 56 of the inner panel 34 preferably has a width 110 that is at least three-fourths (¾) of the width 112 of the inner panel. Also, the first or second fastening panel 100 or 104 attached to the front 56 of the inner panel 34 preferably has a height 114 that is at least one-half (½) the height 116 of the inner panel. The first or second fastening panel 100 or 104 attached to the front 76 of the flap 36 preferably has a width 120 that is at least three-fourths (¾) of the width 122 of the flap. The first or second fastening means 100 or 104 attached to the front 76 of the flap 36 preferably has a width 120 and height 126 that generally corresponds to the width 110 and height 114 of the first or second fastening panel 100 or 104 attached to the front 56 of the inner panel 34. The size of the fastening panels 100 and 104 as well as the positioning thereof on the front 56 of the inner panel 34 and the front 76 of the flap 36 help allow an effective seal around the padlock 12 and chain links 28 to be achieved.

Figure 4A:
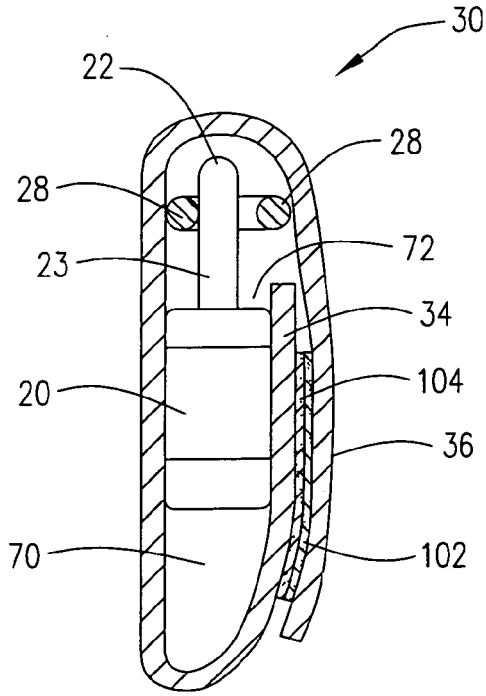
FIG. 4A is a cross-section view taken along line 4A-4A of FIG. 4.

Referring now to FIGS. 3, 4 and 4A, use of the padlock protector pouch 30 to cover and protect the padlock 12, including the padlock body 20 and padlock shackle 22, and associated chain links 28 of the chain 14 (as illustrated in FIGS. 1 and 1A) will be described. As illustrated, the padlock protector pouch 30 can be used to cover and protect the padlock 12 and chain links 28 without unlocking the padlock and removing the chain links therefrom. Specifically, as best shown by FIG. 3, the padlock 12 is inserted into the pocket 70 through the opening 72 therein with the corresponding chain links 28 extending through the openings 90 in the sides 92 of the pouch 30. As shown by FIGS. 4 and 4A, the flap 36 is folded over the inner panel 34 and the first and second panels 100 and 104 are detachably interlocked together to fasten the flap to the inner panel. The back panel 32, inner panel 34 and flap 36 are of a size and thickness and formed of a material such that the padlock protector pouch 30 snugly covers the padlock 12, including the padlock body 20 and padlock shackle 22, as well as the chain links 28 within the pouch when the flap 36 is attached to the inner panel 34 over the pocket 70. The back panel 32, inner panel 34 and flap 36 are preferably of a size and thickness and formed of a material such that the flap 36 conforms to the padlock 12, including the padlock body 20 and padlock shackle 22, and the chain links 28 when the flap is attached to the inner panel.

The back panel 32, inner panel 34 and flap 36 of the padlock protector pouch 30 are formed of a pliable, elastic material. Preferably, the back panel 32, inner panel 34 and flap 36 of the padlock protector pouch 30 are formed of a weather resistant material. More preferably, the back panel 32, inner panel 34 and flap 36 of the pouch 30 are formed of neoprene. Neoprene has several advantages. For example, it is waterproof and is commercially available in different thicknesses allowing thicker material to be utilized in colder weather applications. More importantly, neoprene is pliable and elastic which allows it to conform to the padlock 12, including the padlock body 20 and shackle 22, as well as the chain links 28 of the chain 14 and thereby provide an effective seal.

A tab 140 extends around the opposing side edges 52 of the back panel 32, the opposing side edges 84 of the flap 36 and the opposing side edges 64 of the inner panel 34 to protect the side edges from abrasion. The tab 140 preferably also extends around the top edge 60 of the inner panel 34 to protect the top edge of the inner panel from abrasion. The tab can be formed out of a tear resistant material such as nylon.

Figure 5:
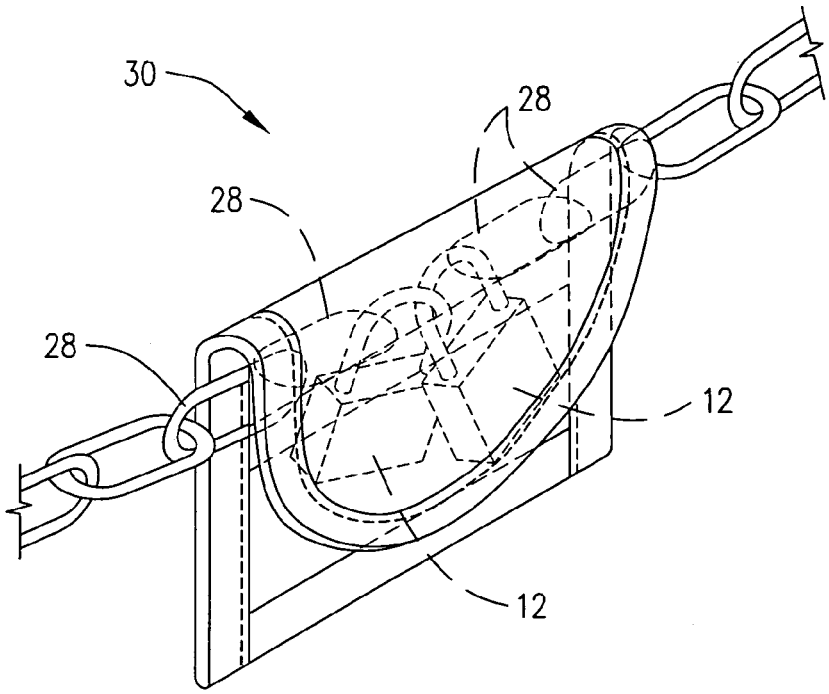
FIG. 5 is a perspective view showing the inventive padlock protector pouch in a closed position with two padlocks and chains therein.
Figure 6:
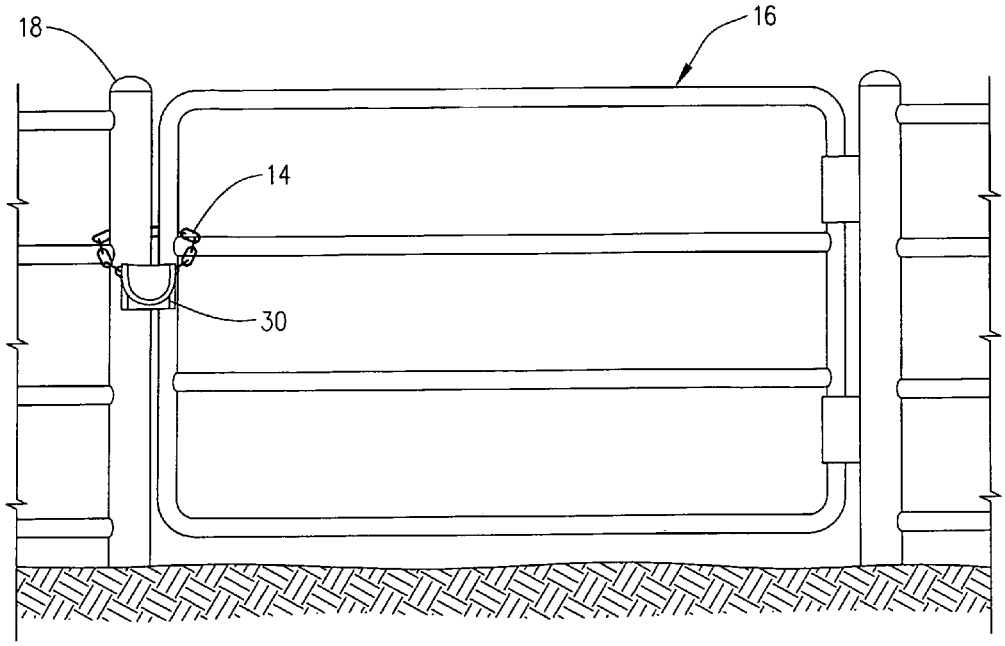
FIG. 6 is a front view of a typical gate locked in a closed position using a padlock and chain having the inventive padlock protector cover thereon.

As shown by FIG. 5, the inventive padlock protector pouch 30 can be utilized in the same manner to cover and protect a plurality of padlocks 12 and associated chain links 28. FIG. 6 illustrates the padlock protector pouch 30 in use to cover and protect the padlock 12 and chain links 28 illustrated by FIGS. 1 and 1A. Again, an advantage of the invention is that the padlock protector pouch 30 can be used to cover and protect the padlock and chain links without unlocking the padlock and removing the chain links therefrom. This allows the padlock protector pouch 30 to be conveniently installed and removed as needed.

Figure 7:
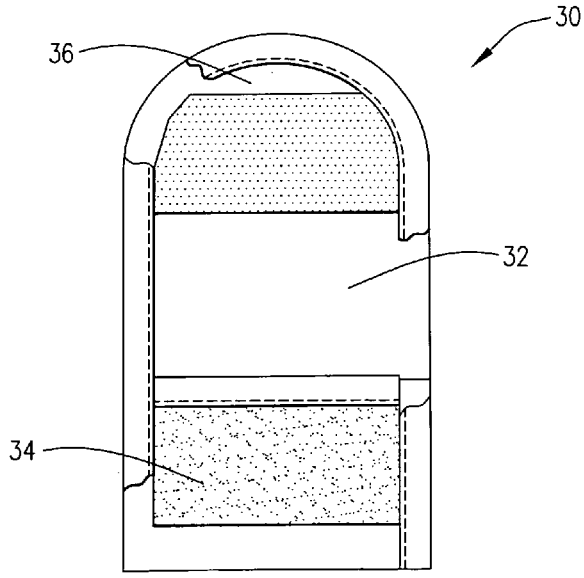
FIG. 7 is a front cutaway view illustrating one method of manufacturing the inventive padlock protector.

Referring now to FIG. 7, a method of manufacturing the inventive padlock protector pouch 30 will be described. The back panel 32, inner panel 34 and flap 36 are cut out of a corresponding piece of neoprene or other similar material as one piece. In this way, the back panel 32, inner panel 34 and flap 36 are integrally formed. The inner panel 34 is then folded up onto the back panel 32. For example, in this way, the bottom edge 62 of the inner panel 34 is integrally attached to the bottom edge 50 of the back panel 32.

The opposing side edges 64 of the inner panel 34 are then attached to the opposing side edges 52 of the back panel 32 to form the pocket 70 having the opening 72 therein. Preferably, the opposing side edges 64 of the inner panel 34 are sewn to the opposing side edges 52 of the back panel 32 to form the pocket 70.

Next, the first fastening panel 100 is attached to the front 76 of the flap 36. The second fastening panel 104 is then attached to the front 56 of the inner panel 34. A tab 140 is then sewn around the top edge 60 of the inner panel 34. A tab 140 is also sewn around the opposing side edges 52 of the back panel 32, the opposing side edges 64 of the inner panel 34 and the opposing side edges 84 of the flap 36.

In one embodiment, the inventive locking system comprises a padlock 12, including a padlock body 20 and padlock shackle 22, and the inventive padlock protector pouch 30 (as described above). The padlock is capable of receiving chain links of a chain (such as the chain links 28 of the chain 14) to lock the links together. The padlock protector pouch 30 is used to cover and protect the padlock 12, including the padlock body 20 and padlock shackle 22, and the chain links received by the padlock when the chain links are locked together by the padlock. The padlock protector pouch 30 is capable of covering and protecting the padlock 12 and chain links without unlocking the padlock 12 and removing the chain links therefrom.

In another embodiment, the inventive locking system comprises a chain 14 including a plurality of chain links 28 attached to one another, a padlock 12 including a padlock body 20 and a padlock shackle 22, and the inventive padlock protector pouch 30 (as described above). The padlock 12 is capable of receiving one or more of the chain links 28 of the chain 14 to lock the links together. The padlock protector pouch can be used to cover and protect the padlock 12, including the padlock body 20 and padlock shackle 22, and the chain links 28 received by the padlock 12 when the chain links 28 are locked together by the padlock. The padlock protector pouch 30 is capable of covering and protecting the padlock 12 and chain links 28 without unlocking the padlock and removing the chain links therefrom.

Thus, the present invention is well adapted to carry out the objects and attain the ends and advantages mentioned as well as those which are inherent therein.

What is claimed is:

1. A locking system, comprising:

a chain including a plurality of chain links attached to one another;

a padlock including a padlock body and a padlock shackle, said padlock capable of receiving one or more of said chain links of said chain to lock said links together;

a padlock protector pouch that can be used to cover and protect said padlock, including said padlock body and said padlock shackle, and said chain links received by said padlock when said chain links are locked together by said padlock, said padlock protector pouch being capable of covering and protecting said padlock and chain links without unlocking the padlock and removing the chain links therefrom, said padlock protector pouch including:

a back panel having a front, a back, a top edge, a bottom edge and opposing side edges disposed between said top edge of said back panel and said bottom edge of said back panel;

an inner panel having a front, a back, a top edge, a bottom edge and opposing side edges disposed between said top edge of said inner panel and said bottom edge of said inner panel, said bottom edge and opposing side edges of said inner panel being attached to said bottom edge and opposing side edges of said back panel to form a pocket having an opening for receiving said padlock, said top edge of said inner panel being spaced below said top edge of said back panel;

a flap having a front, a back, a top edge, a bottom edge and opposing side edges disposed between said top edge of said flap and said bottom edge of said flap, said flap being attached to said top edge of said back panel and attachable to said front of said inner panel over said opening in said pocket, said pouch including an opening in each side of said pouch between said top edge of said inner panel and said top edge of said back panel for receiving said chain links when said flap is attached to said front of said inner panel over said opening in said pocket; and a fastening system attached to one or both of said front of said inner panel and said front of said flap for attaching said flap to said front of said inner panel over said opening in said pocket, said padlock protector pouch being of a size sufficient for said flap to extend over and cover all of said padlock, including said padlock body and said padlock shackle, and said chain links extending through said openings in said sides of said pouch and attached to said padlock shackle when said padlock is positioned in said pocket with said chain links attached thereto and said flap is attached to said front of said inner panel and over said opening in said pocket.

2. The locking system of claim 1 wherein said openings in said sides of said pouch are at least three-fourths (¾) of an inch in length from top to bottom.

3. The locking system of claim 1 wherein said fastening system is a hook and loop-type fastening system including a first fastening panel having a plurality of small hooks extending therefrom and a second fastening panel having a plurality of corresponding loops extending therefrom, one of said first and second fastening panels being attached to said front of said flap and the other of said first and second fastening panels being attached to said front of said inner panel, said first fastening panel detachably interlocking with said second fastening panel to fasten said flap to said inner panel.

* * * * *